US010434667B2

(12) United States Patent
Nawaz

(10) Patent No.: US 10,434,667 B2
(45) Date of Patent: Oct. 8, 2019

(54) DOUBLE SPRING FOLDING KNIFE

(71) Applicant: JAGUAR IMPORTS, LLC, Orlando, FL (US)

(72) Inventor: Babar Nawaz, Orlando, FL (US)

(73) Assignee: JAGUAR IMPORTS, LLC, Orlando, FL (US)

( * ) Notice: Subject to any disclaimer, the term of this patent is extended or adjusted under 35 U.S.C. 154(b) by 24 days.

(21) Appl. No.: 15/690,742

(22) Filed: Aug. 30, 2017

(65) Prior Publication Data

US 2019/0061180 A1 Feb. 28, 2019

(51) Int. Cl.
*B26B 1/04* (2006.01)
*B26B 1/02* (2006.01)

(52) U.S. Cl.
CPC ..... *B26B 1/042* (2013.01); *B26B 1/02* (2013.01); *B26B 1/044* (2013.01)

(58) Field of Classification Search
CPC ..... B26B 1/042; B26B 1/044; B26B 1/046; B26B 1/048; B26B 1/02
See application file for complete search history.

(56) References Cited

U.S. PATENT DOCUMENTS

| | | | | |
|---|---|---|---|---|
| 4,776,094 | A | 10/1988 | Glesser | |
| 7,905,022 | B2 | 3/2011 | Hawk et al. | |
| 8,893,389 | B2 | 11/2014 | Freeman | |
| 2003/0213134 | A1* | 11/2003 | Sakai | B26B 1/048 30/161 |
| 2015/0352731 | A1* | 12/2015 | France | B26B 1/048 30/159 |
| 2016/0067871 | A1* | 3/2016 | Onion | B26B 1/044 30/158 |
| 2018/0001488 | A1* | 1/2018 | Wang | B26B 1/04 |
| 2018/0133907 | A1* | 5/2018 | Kao | B26B 1/042 |

* cited by examiner

*Primary Examiner* — Stephen Choi
(74) *Attorney, Agent, or Firm* — Matthew G. McKinney, Esq.

(57) ABSTRACT

A double spring folding knife includes a handle having a curvilinear groove on an interior surface, and a knife blade. The knife blade has a locking pin that extends away from a first side of the knife blade and is configured to slidingly engage the curvilinear groove. A bow spring is fixed to the handle and is orientated to interact with the locking pin in order to exert a force on the locking pin during a portion of travel along the curvilinear groove. The knife also includes a coil spring having a first end fixed to the handle and a second end fixed to a second side of the knife blade, where the coil spring is configured to exert an opening force on the knife blade after the locking pin has traveled past the bow spring along the curvilinear groove.

20 Claims, 5 Drawing Sheets

FIG. 2
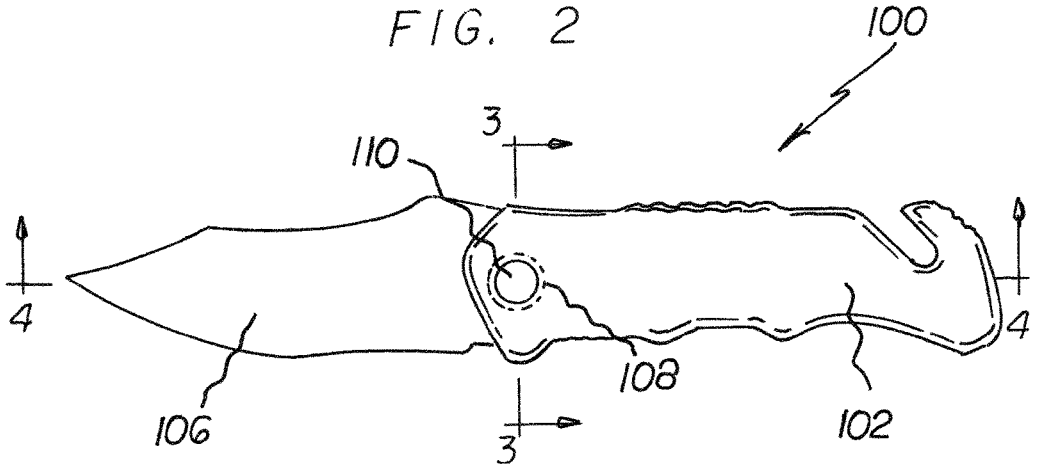
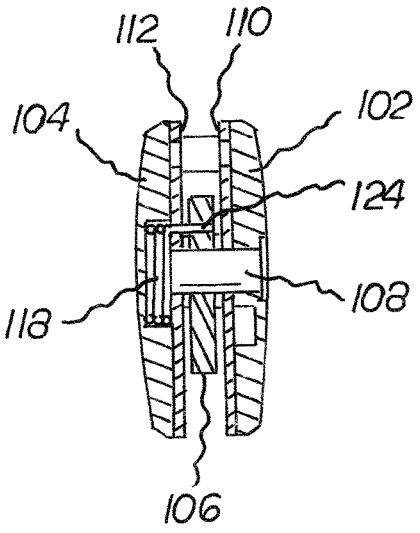
FIG. 3

FIG. 4
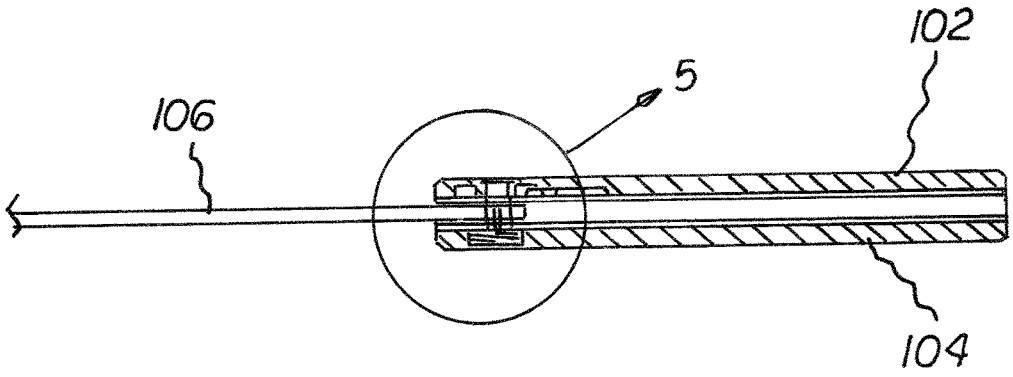
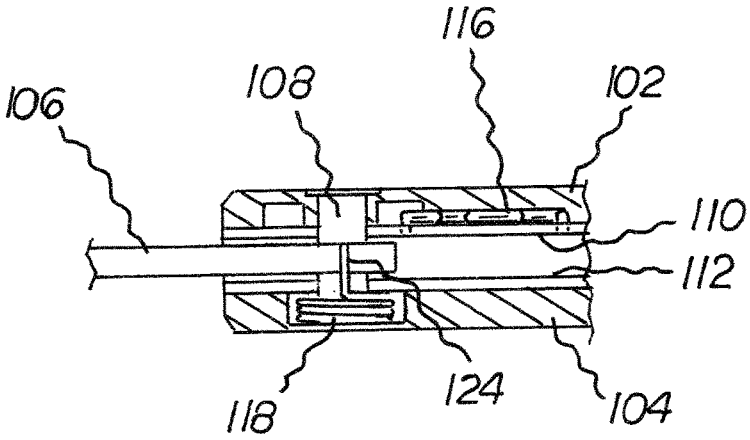
FIG. 5

FIG. 6
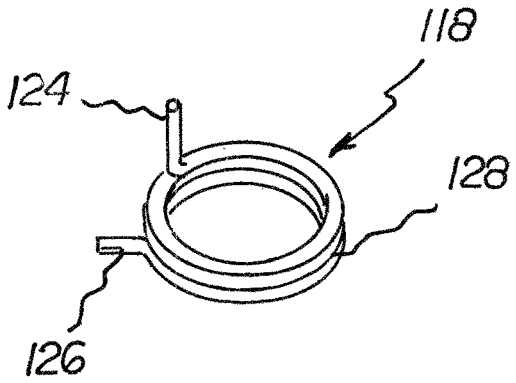
FIG. 7
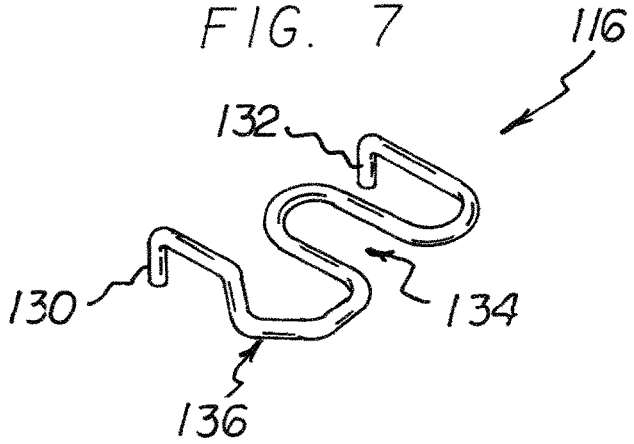
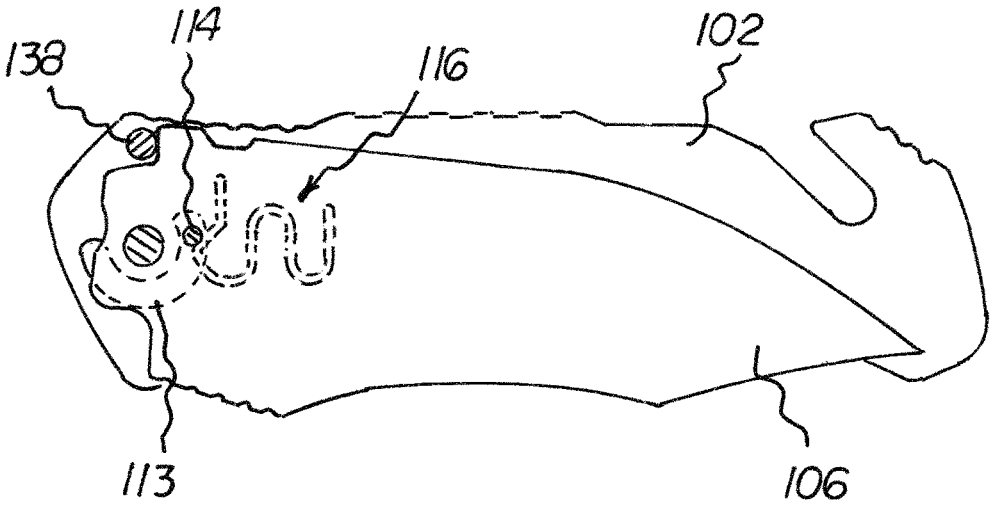
FIG. 8

FIG. 9
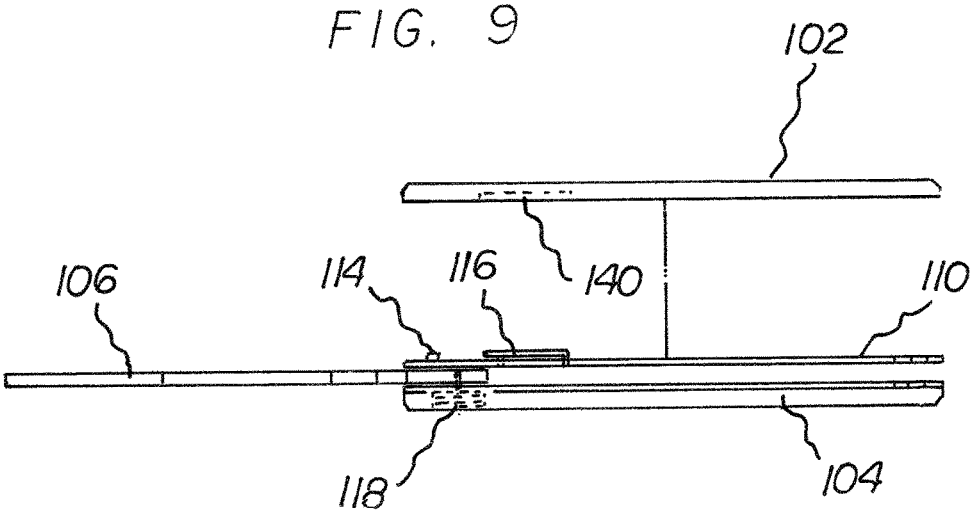
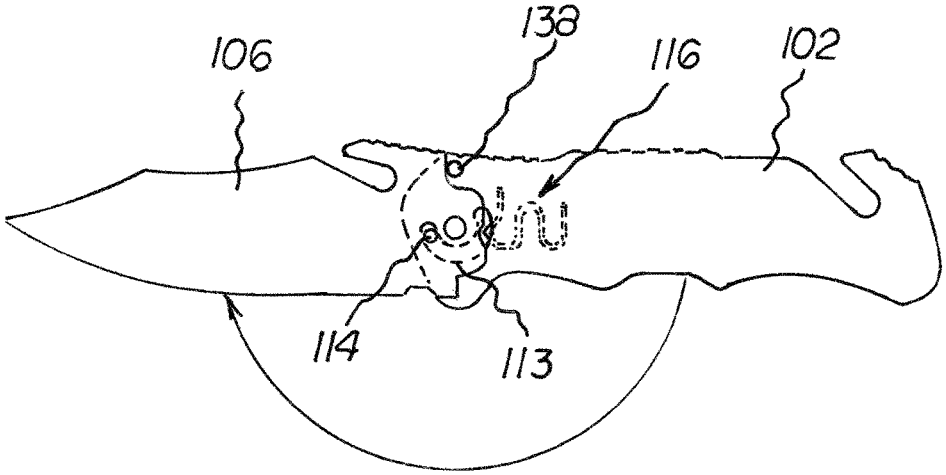
FIG. 10

DOUBLE SPRING FOLDING KNIFE

TECHNICAL FIELD

The present invention relates to the field of knives, and, more particularly, to a double spring folding knife.

BACKGROUND

A folding knife is a type of knife that includes a handle and a blade pivotally attached to the handle. The blade is designed to swing out from the handle into the open position, and to remain folded into the handle when in the closed position.

A typical folding knife includes features to make the knife more useful and easier to operate. For example, these features may include a spring mechanism to assist the user in opening the knife. However, adding the spring mechanism to assist with opening the knife blade may also lead to the knife blade unintentionally swinging open when not intended. For example, when it is in the user's pocket or if the knife is accidentally dropped. This can lead to personal injury.

Prior attempts to address this shortcoming have been to include a locking mechanism to the folding knife in order to lock the knife blade in the closed position. However, the known locking mechanisms substantially increase the cost and complexity of manufacturing the folding knife. Accordingly, there is a need for a folding knife that includes a simplified feature to prevent the knife blade from unintentionally swinging open that does not increase the complexity or manufacturing costs.

It is, therefore, to the effective resolution of the aforementioned problems and shortcomings of the prior art that the present invention is directed.

However, in view of the prior art at the time the present invention was made, it was not obvious to those of ordinary skill in the pertinent art how the identified needs could be fulfilled.

SUMMARY

In a particular embodiment, a double spring folding knife is disclosed. The double spring folding knife includes a handle that has a first side and a second side, and forms a slot therebetween. The knife also includes a knife blade having a first end, a second end, and an opening proximate the second end. An axle is secured within the handle and through the opening proximate the second end of the knife blade, where the knife blade is configured to rotate about the axle to swing open from the slot. The knife also includes a first liner adjacent a first side of the knife blade and an interior surface of the first side of the handle. The first liner includes a curvilinear groove formed therein. A locking pin is proximate to a second end of the knife blade and extends away from a first side of the knife blade. The locking pin sliding engages the curvilinear groove and extends through the curvilinear groove to an opposing side of the first liner.

A bow spring is fixed to the opposing side of the first liner and is orientated to interact with the locking pin to exert a force on the locking pin during a portion of travel along the curvilinear groove. The knife also includes a coil spring that is coaxially positioned around the axle and has a first end fixed to the second side of the handle and a second end fixed to a second side of the knife blade. The coil spring is configured to exert an opening force on the knife blade after the locking pin has traveled past the bow spring along the curvilinear groove.

It is therefore an object of the present invention to provide for an improvement that overcomes the aforementioned inadequacies of the prior art and provides a significant contribution to the advancement of folding knives.

These and other important objects, advantages, and features of the invention will become clear as this description proceeds. The invention accordingly comprises the features of construction, combination of elements, and arrangement of parts that will be exemplified in the description set forth hereinafter.

Both the foregoing general description and the following detailed description are explanatory and are not restrictive of the invention. The accompanying drawings, which are incorporated in and constitute part of the specification, illustrate embodiments of the present invention and together with the general description, serve to explain principles of the present invention.

BRIEF DESCRIPTION OF THE DRAWINGS

FIG. 2 is a right side elevational view of the double spring folding knife;

FIG. 3 is a partial cross sectional view taken in the direction of line 3-3 of FIG. 2;

FIG. 4 is a partial cross sectional view taken in the direction of line 4-4 of FIG. 2;

FIG. 5 is a detail view of the double spring action of FIG. 4;

FIG. 6 is a perspective view of a coil spring of the double spring folding knife;

FIG. 7 is a perspective view of a bow spring of the double spring folding knife;

FIG. 8 is a partial elevational view showing the bow spring action;

FIG. 9 is a partial exploded view of the double spring folding knife; and

FIG. 10 is a side elevational view showing the bow spring action as the knife blade swings out from the handle.

DETAILED DESCRIPTION

Figure 1:
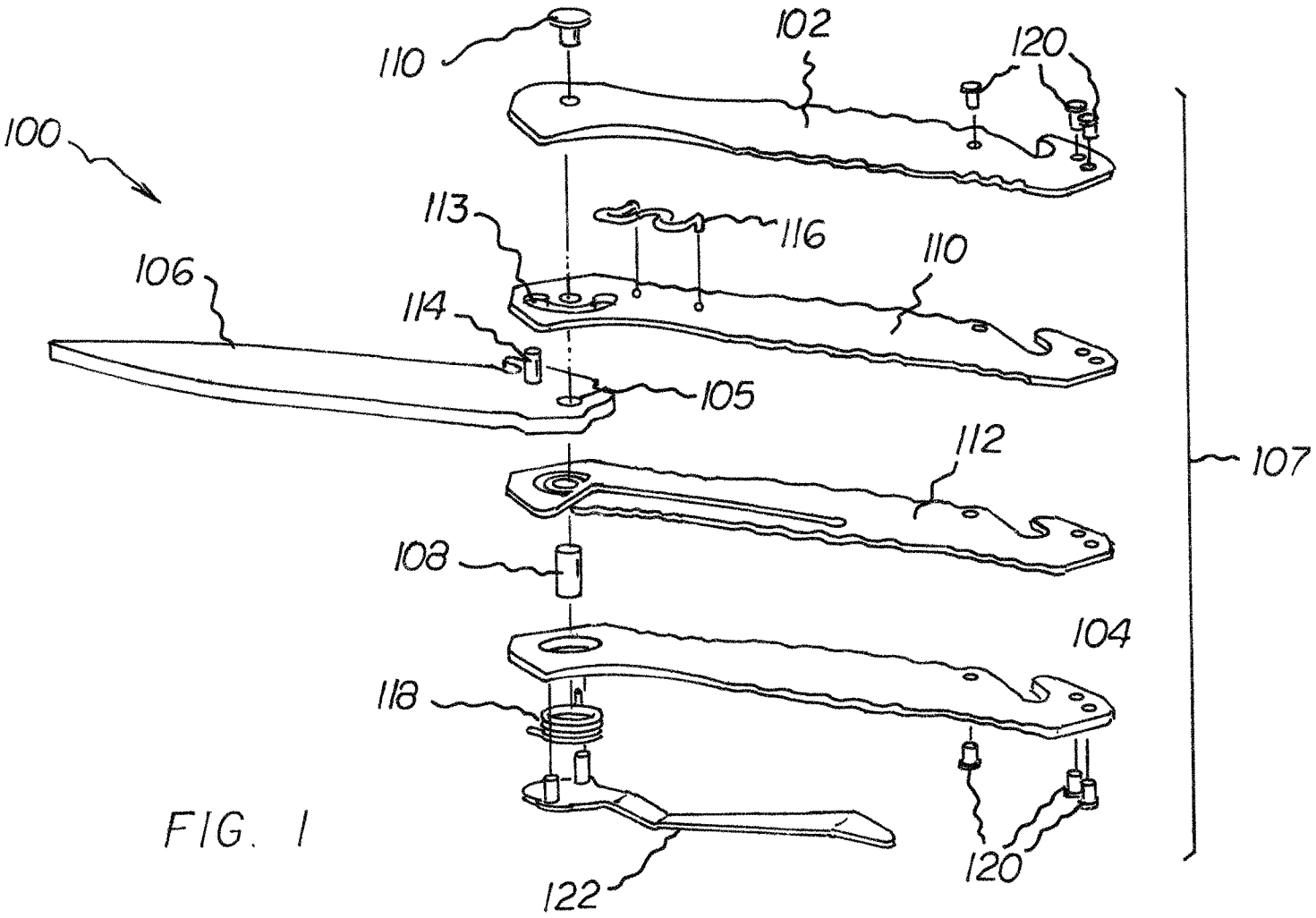
FIG. 1 is an exploded perspective view of a double spring folding knife in accordance with an embodiment of the invention.

The present invention will now be described more fully hereinafter with reference to the accompanying drawings, in which preferred embodiments of the invention are shown. Like numbers refer to like elements throughout.

Referring initially to FIGS. 1 and 2, a double spring folding knife is generally designated 100. The knife 100 includes a handle 107 having a first side 102 and a second side 104, and forming a slot therebetween. The handle 107 is held together by a plurality of rivets 120 or other similar fasteners. A knife blade 106 is within the slot and an opening 105 is proximate an end of the blade 106 secured between the first and second sides 102, 104 of the handle 107. The opening 105 of the blade 106 is used to slide an axle 108 through so that the blade 106 can rotate about the slot to swing open from the handle 107. The axle 108 has a cap 110 that slides inside the axle 108 in order to fixedly secure the axle 108 within the handle 107.

The double spring folding knife 100 also includes a first liner 110 adjacent a first side of the knife blade 106 and an interior surface of the first side 102 of the handle 107. In addition, the first liner 110 has a curvilinear groove 113 formed therein that is used in conjunction with the action of a bow spring 116, described in more detail below. A belt clip 122 may be secured to the second side 104 of the handle 107 and can be used to removably attach the knife 100 to a belt of a wearer.

A locking pin 114 is proximate to the end of the knife blade 106 and extends away from a first side of the knife blade 106. The locking pin 114 sliding engages the curvilinear groove 113 and extends through the curvilinear groove 113 to an opposing side of the first liner 110. The bow spring 116 is fixed to the opposing side of the first liner 110 and orientated to interact with the locking pin 114 to exert a force on the locking pin 114 during a portion of travel along the curvilinear groove 113. The bow spring 116 is sandwiched between the first side 102 of the handle 107 and the first liner 110. The bow spring comprises steel or any suitable material. The bow spring 116 is configured to be compressed by the locking pin 114 as the blade 106 swings out and the locking pin 114 has to move past the elbow of the bow spring 116. Once the blade 106 is open, the bow spring 116 is not in contact with the locking pin 114.

A coil spring 118 is coaxially positioned around the axle 108 and has a first end fixed to the second side 104 of the handle 107 and a second end fixed to a second side of the knife blade 106. The coil spring 118 is configured to exert an opening force on the knife blade 106 after the locking pin 114 has traveled past an elbow of the bow spring 116 along the curvilinear groove 113.

The double spring folding knife also includes a second liner 112 adjacent the second side of the knife blade 106 and an interior surface of the second side 104 of the handle 107. The second liner 112 is biased to engage a bottom edge of the end of the knife blade 106 to lock the knife blade in an open position. A stop pin 138 is orientated between the first side 102 and second side 104 of the handle 107 and is configured to engage and stop the end of the knife blade 106 when swinging the knife blade into the slot formed in the handle 107.

Referring now to FIG. 3, a partial cross section taken in the direction of line 3-3 is illustrated. The coil spring 118 has a first end 124 that extends perpendicular from the windings of the coil spring 118. The first end 124 is inserted into the knife blade 106 so that the coil spring 118 is placed under compression and stores mechanical energy when the knife blade 106 is in the closed position. The second end 126 of the coil spring 118 is fixed. Accordingly, when a user applies force to swing open the knife blade 106, the stored mechanical energy is released and assists the knife blade 106 in swinging open.

A detailed view of the coil spring 118 and bow spring 116 is shown in FIGS. 4 and 5. For example, FIG. 4 is a partial cross sectional view showing the knife blade 106 in the open position. FIG. 5 shows the relation of the bow spring 116 on one side of the knife blade 106 and the coil spring 116 on the other side of the knife blade 106.

Once example of a coil spring 118 that may be used with the double spring foldable knife 100 is shown in FIG. 6. The coil spring 118 include a first end 124 that extends perpendicular to the windings 128. As explained above, the first end is secured to the knife blade and is placed under compression when the knife blade 106 is in the closed position. The second end 126 is fixed so that it cannot move. Different number of windings 128 may be used and the diameter of the coil spring 118 may also be varied as desired in order to provide the necessary opening force assistance.

The bow spring 116 is shown in FIG. 7 to illustrate its configuration in more detail. As explained above, the bow spring 116 is used to prevent accidental opening of the knife blade 106. In order for the knife blade 106 to swing open, a force of the bow spring must first be overcome. In particular, the bow spring 116 includes an elbow 136 that protrudes along a first side of the bow spring 116. The bow spring 116 has a generally W-shape, where the middle portion 134 has a hairpin curve or bend. The bow spring 116 fits inside a compartment 140 of the first side 102 of the handle 107.

Accordingly, the locking pin 114 pushes inward on the bow spring 116 as the locking pin 114 tries to move past the elbow 136 as shown in FIGS. 8-10. The middle portion 134 of the bow spring 116 provides resistance to the elbow 134 being pushed inward by the locking pin 114. However, once the locking pin 114 is forced past the elbow 136, the coil spring 118 is positioned to release its stored energy and assist in swinging the knife blade 106 open.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A double spring folding knife comprising:

a handle having a first side and a second side, and forming a slot therebetween;

a knife blade having a first end and a second end, and an opening proximate the second end;

an axle secured within the handle and through the opening proximate the second end of the knife blade, the knife blade configured to rotate about the axle to swing open from the slot;

a first liner adjacent a first side of the knife blade and an interior surface of the first side of the handle, the first liner having a curvilinear groove formed therein;

a locking pin proximate to a second end of the knife blade and extending away from a first side of the knife blade, the locking pin slidingly engaging the curvilinear groove and extending through the curvilinear groove to an opposing side of the first liner;

a bow spring fixed to the opposing side of the first liner and orientated to interact with the locking pin to exert a force on the locking pin during a portion of travel along the curvilinear groove, the bow spring has an elbow along a first side of the bow spring that is positioned to protrude into the curvilinear groove; and a coil spring coaxially positioned around the axle having a first end fixed to the second side of the handle and a second end fixed to a second side of the knife blade, the coil spring configured to exert an opening force on the knife blade after the locking pin has traveled past the bow spring along the curvilinear groove.

2. The double spring folding knife of claim 1, further comprising a second liner adjacent the second side of the knife blade and an interior surface of the second side of the handle.

3. The double spring folding knife of claim 2, wherein the second liner is biased to engage a bottom edge of the second end of the knife blade to lock the knife blade in an open position.

4. The double spring folding knife of claim 1, further comprising a stop pin orientated between the first and second sides of the handle and configured to engage and stop the second end of the knife blade when swinging the knife blade into the slot.

5. The double spring folding knife of claim 1, wherein an edge of the knife blade extends beyond the handle when the knife blade is in a closed position within the slot.

6. The double spring folding knife of claim 1, wherein the bow spring is sandwiched between the first side of the handle and the first liner.

7. The double spring folding knife of claim 1, wherein the bow spring comprises a middle portion having a U-shaped bend.

8. The double spring folding knife of claim 1, wherein the bow spring is configured to be compressed by the locking pin.

9. The double spring folding knife of claim 1, wherein the bow spring does not contact the locking pin when the knife blade is in an open position.

10. A double spring folding knife comprising:

a handle;

a knife blade having a first end and a second end, and an opening proximate the second end;

a first liner within the handle having a curvilinear groove formed therein;

a locking pin proximate to the second end of the knife blade and extending away from a first side of the knife blade, the locking pin slidingly engaging the curvilinear groove and extending through the curvilinear groove to an opposing side of the first liner; and a bow spring fixed to the opposing side of the first liner and orientated to interact with the locking pin to exert a force on the locking pin during a portion of travel along the curvilinear groove, the bow spring has an elbow along a first side of the bow spring that is positioned to protrude into the curvilinear groove.

11. The double spring folding knife of claim 10, further comprising an axle secured within the handle and through the opening proximate the second end of the knife blade, the knife blade configured to rotate about the axle to swing open from the slot.

12. The double spring folding knife of claim 10, further comprising a coil spring having a first end fixed to the handle and a second end fixed to a second side of the knife blade, the coil spring configured to exert an opening force on the knife blade after the locking pin has traveled past the bow spring along the curvilinear groove.

13. The double spring folding knife of claim 10, wherein the handle comprises a second liner adjacent a second side of the knife blade and an interior surface of the handle.

14. The double spring folding knife of claim 13, wherein the second liner is biased to engage a bottom edge of the second end of the knife blade to lock the knife blade in an open position.

15. The double spring folding knife of claim 10, further comprising a stop pin configured to engage and stop the second end of the knife blade when swinging the knife blade into the handle.

16. The double spring folding knife of claim 10, wherein an edge of the knife blade extends beyond the handle when the knife blade is in a closed position within the handle.

17. The double spring folding knife of claim 10, wherein the bow spring is sandwiched between the first side of the handle and the first liner.

18. The double spring folding knife of claim 10, wherein the bow spring comprises a middle portion having a U-shaped bend.

19. The double spring folding knife of claim 10, wherein the bow spring is configured to be compressed by the locking pin.

20. A double spring folding knife comprising:

a handle having a curvilinear groove on an interior surface;

a knife blade having a first end and a second end, and an opening proximate the second end;

a locking pin proximate to the second end of the knife blade and extending away from a first side of the knife blade and configured to slidingly engage the curvilinear groove;

a bow spring fixed to the handle and orientated to interact with the locking pin to exert a force on the locking pin during a portion of travel along the curvilinear groove, the bow spring has an elbow along a first side of the bow spring that is positioned to protrude into the curvilinear groove; and a coil spring having a first end fixed to the handle and a second end fixed to a second side of the knife blade, the coil spring configured to exert an opening force on the knife blade after the locking pin has traveled past the bow spring along the curvilinear groove.

* * * * *